US006931905B2

(12) United States Patent
Rubalcava et al.

(10) Patent No.: US 6,931,905 B2
(45) Date of Patent: Aug. 23, 2005

(54) METHOD AND APPARATUS FOR FORMING CONTAINER BODIES

(75) Inventors: Manuel P. Rubalcava, San Jose, CA (US); James A. McClung, N. Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 309 days.

(21) Appl. No.: 10/413,889

(22) Filed: Apr. 15, 2003

(65) Prior Publication Data

US 2004/0206150 A1 Oct. 21, 2004

(51) Int. Cl.[7] ..... B21D 43/05
(52) U.S. Cl. ..... 72/361; 72/405.13
(58) Field of Search ..... 72/346, 361, 405.11, 72/405.12, 405.13, 405.15

(56) References Cited

U.S. PATENT DOCUMENTS

| | | | |
|---|---|---|---|
| 4,454,743 | A | 6/1984 | Bulso, Jr. et al. |
| 4,535,618 | A | 8/1985 | Bulso, Jr. et al. |
| 5,440,933 | A | 8/1995 | Brammer et al. |
| 5,626,048 | A | 5/1997 | McClung |
| 5,798,453 | A | 8/1998 | Brammer et al. |
| 5,823,041 | A | 10/1998 | McClung |
| 6,237,388 | B1 | 5/2001 | McClung et al. |

*Primary Examiner*—Lowell A. Larson
(74) *Attorney, Agent, or Firm*—Eric A. Lerner; Eckert Seamans Cherin & Mellott, LLC

(57) ABSTRACT

A pressure sleeve for holding a container body blank in a die cavity at a redraw station in a press has a pair of notches formed in opposed side walls thereof. The notches provide clearance for a pair of opposed grippers of a transfer mechanism which moves container body blanks and formed container bodies between work stations of the press. The notches provide reduced travel distance of the transfer grippers thereby increasing press output speed.

20 Claims, 15 Drawing Sheets

METHOD AND APPARATUS FOR FORMING CONTAINER BODIES

BACKGROUND OF THE INVENTION

1. Technical Field

The invention relates to an improved system and apparatus for producing bodies for two piece containers. More particularly, the invention relates to a transfer apparatus mounted on the base of a press for reciprocal and linear movement along the base in combination with a pressure sleeve engageable with the can body blanks and formed can bodies which reduces the travel distance of the gripping mechanism of the transfer apparatus to increase the operational speed of the press.

2. Background Information

It is well known in the container forming art to form two piece containers, that is, a container in which the walls and bottom of the container are a one piece member and the top end closure is a separate piece, by stamping a plurality of blanks in a single or double action press from a strip of sheet metal and then subsequently drawing, redrawing, and forming the desired can body configuration into the blank in a series of work stations in the press.

These presses use multiple stage dies, that is, a single downward stroke of the press may simultaneously draw a can body blank into a partially formed can body having a desired shape at a first work station while at another work station in the press the can body will be redrawn into a final configuration or formed with a stepped shoulder or specific profile bottom thereto, with another station then trimming an annular outer flange of the can body to form the final container body configuration.

In these multiple station presses, a transfer mechanism moves the can body blank, the first stage can body and final can body between the work stations. This mechanism usually consists of a pair of gripper bars which are moveable linearly along the press in the direction of travel of the workpieces and can bodies, for transferring the workpieces and can bodies between adjacent work stations. This mechanism also moves perpendicular to this linear direction when gripping the workpieces and can bodies for placing and removing the workpieces at the various work stations for subsequent linear transfer between the work stations. The amount of movement of these grippers perpendicularly toward and away from the travel axis of the workpieces effects the speed of the press since the gripper must retract a sufficient distance to provide clearance for the reciprocal movement of a pressure sleeve or other tooling which is reciprocated by an inner or outer ram of the press. This tooling, and in particular, a pressure sleeve enters a can body blank and holds it in position in an adjacent redraw die cavity of the press at the redraw work station while a concentrically located internal die redraws the blank into a first stage can body. It is desirable to maintain this reciprocal movement of the grippers to a minimum to enable maximum press speed to be obtained while providing secure gripping of the workpiece and subsequently formed can body for moving it linearly along the base of the press in the direction of the press axis.

Recently, various configured containers are being formed from sheet metal other than round containers, such as those having a generally rectangular or elongated oval shaped configurations used for the storage of canned meat products, such as sold under the trademark SPAM® and TREET®. To provide for the secure retention and movement of these elongated can bodies the grippers are formed with a concave recess with curved outer ends, which ends extend partially around the curved corners of the formed can body to securely grip the can body without applying excess pressure to the flexible elongated side walls of the can body. These outwardly extending gripping corners increase the amount of travel of the gripping mechanism toward the retracted position in order to provide clearance from the pressure sleeve, which will be engaged within the can body blank while the transfer mechanism moves linearly along the press to return to a start position for gripping another can body blank. This increased travel reduces the speed of press operation.

Therefore, there is a need for an improved method and apparatus for forming container bodies in a press having a transfer mechanism with grippers which have reduced travel when moving toward a retracted or non-gripping position, to provide clearance from a pressure sleeve while the sleeve is engaged with the can blanks to enable the press to have increased production speed.

BRIEF SUMMARY OF THE INVENTION

Objectives of the invention include providing an improved method and apparatus for forming can bodies in a press, in which the travel distance of the transfer mechanism toward the retracted or non-gripping position is reduced to enable the cycle speed of the press to be increased by forming opposed cutouts or notched areas in the side wall of the pressure sleeve, which cutouts enable the transfer mechanism, and in particular the grippers thereof, to move linearly along the press base while the pressure sleeve is in holding engagement with the can blank.

A still further feature of the invention is to provide such a method and apparatus which does not effect the operating sequence of the transfer mechanism, nor effect the movement and operation of the pressure sleeve and internal redraw die, and which requires only the unique modification to the pressure sleeve of the present invention at the redraw station.

Another advantage of the invention is to provide such a method and apparatus which achieves the stated objectives in a relatively simple, inexpensive, yet highly efficient manner, and which enables increased press speed to be achieved with only relatively minor but unique changes to the pressure sleeve which is mounted on one of the rams of the press at the redraw station.

BRIEF DESCRIPTION OF THE DRAWINGS

A preferred embodiment of the invention, illustrative of the best mode in which applicant contemplates applying the principles, is set forth in the following description and is shown in the drawings and is particularly and distinctly pointed out and set forth in the appended claims.

Similar numerals refer to similar parts throughout the drawings.

DETAILED DESCRIPTION OF THE INVENTION

Figure 1:
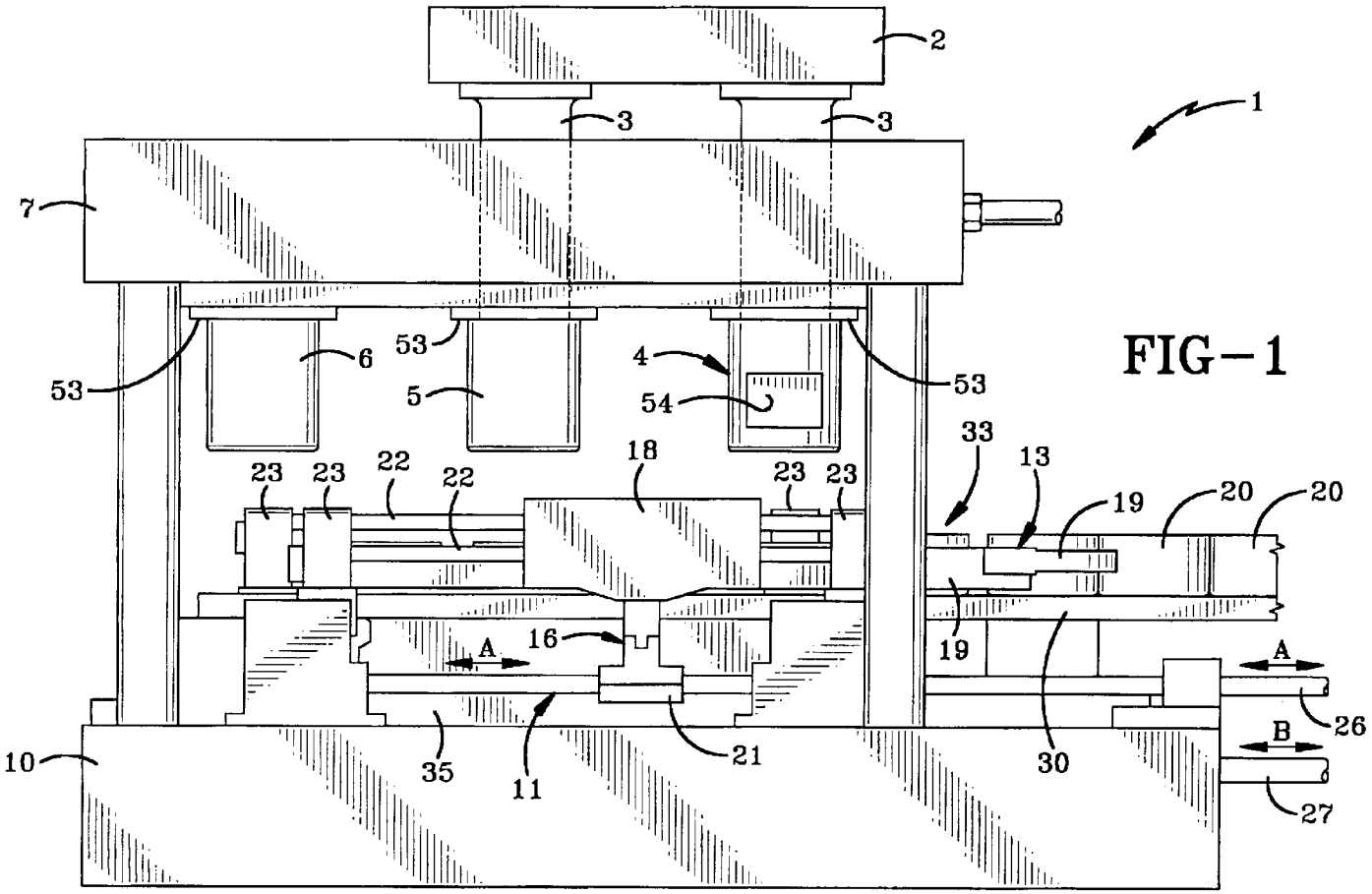
FIG. 1 is a diagrammatic side elevational view of a press having three work stations and a transfer mechanism for transferring workpieces therebetween.

FIGS. 1–4, 6, 9, and 11 show a usual press of the type in which the improved pressure sleeve of the present invention and its coordination with a transfer mechanism of the press is utilized and the method of the invention carried out. The press is indicated generally at 1, and is of a usual construction well known in the can body forming industry. Press 1 preferably will be a double acting press having an inner ram 2 connected to a pair of punch holders 3 and an outer ram 7 on which is mounted pressure sleeves 4, 5, and 6. Outer ram 7 will move pressure sleeves 4, 5 and, 6 in a reciprocal vertical direction and inner ram will move punch holders 3 in a similar vertical direction. Some examples of press 1 and its mode of operation are shown in U.S. Pat. Nos. 5,626,084, 5,823,041, and 6,237,388, the contents of which are incorporated herein by reference. Thus, press 1 is not described in greater detail, and the particular press shown in the drawings is for illustrative purposes only.

Figure 2:
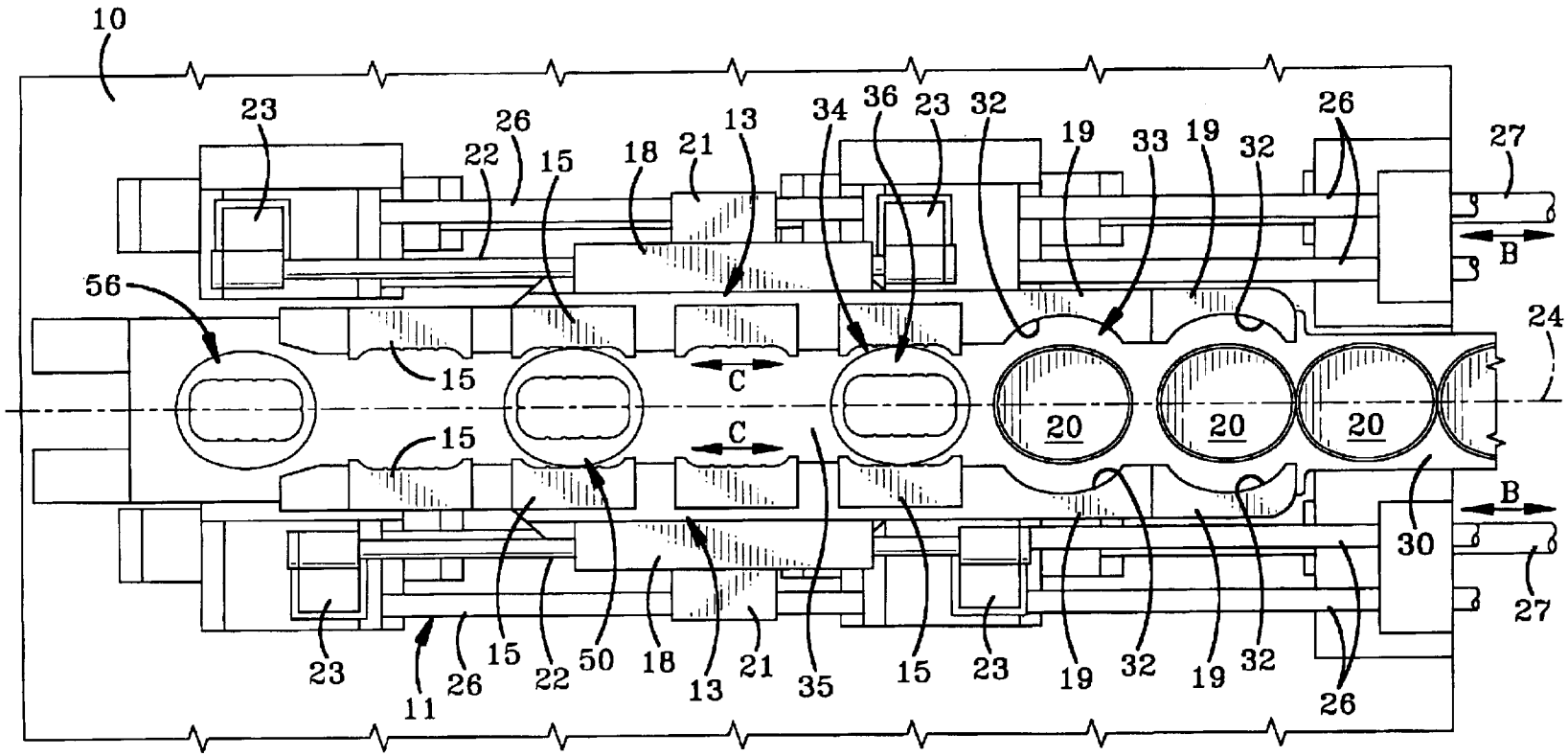
FIG. 2 is a diagrammatic top plan view of the press of FIG. 1, with the transfer mechanism shown in a retracted non-gripping position at the load station.

Press 1 includes a base 10, and a material transfer mechanism indicated generally at 11 (FIG. 2). Transfer mechanism 11 is of a usual construction, and broadly includes a pair of elongated opposed gripper bars indicated generally at 13, each of which contains a plurality of grippers 15, four of which are illustrated in the drawings, which grip a redrawn can body 17, and a pair of grippers 19 which are configured to grip a formed can blank 20. Grippers 15 are generally similar to each other, and are configured to grip a formed generally rectangular-shaped can body 17 of the type shown in U.S. Pat. Nos. 6,237,388 and D-419,442. Grippers 19 are configured for engagement with can blanks 20, which preferably have a generally oval-shaped configuration, prior to being redrawn into can bodies 17.

Each gripper bar 13 is fixedly attached to a mounting block 18 (FIG. 1), which is slidably mounted on a pair of slide rods 22, the ends of which are mounted in a pair of cam boxes 23. Rods 22 extend along press base 10 in a linear direction, parallel with press axis 24, which is the direction along which the can blanks and can bodies move through press 1. Each mounting block 18 is connected to a drive block 21 by a linkage connection 16, which is secured to a drive rod 26 which is connected to a usual drive mechanism (not shown) for reciprocal movement (arrows A, FIG. 1) of blocks 21 and 18, and correspondingly gripper bars 13 linearly along the press base parallel with axis 24.

Figure 3:
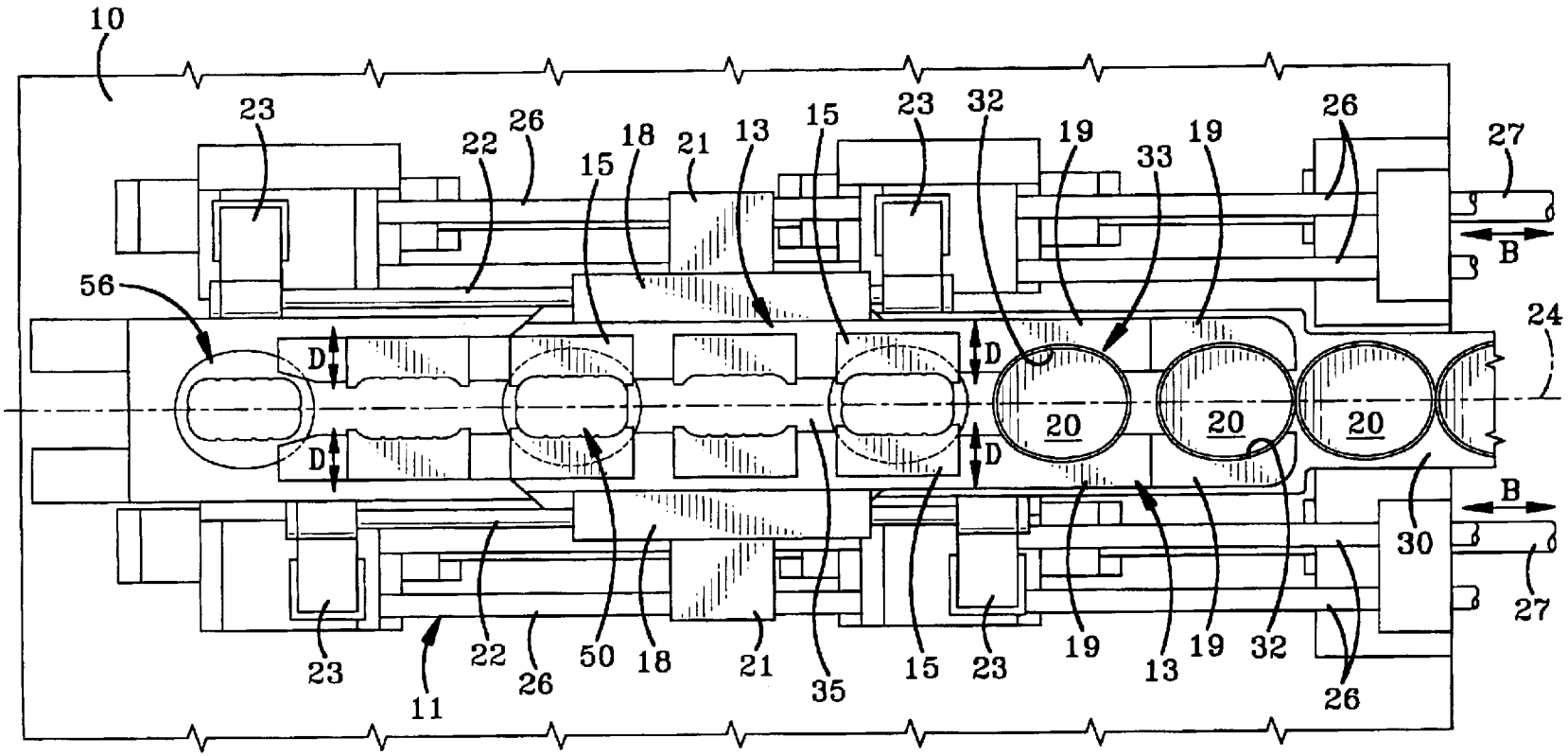
FIG. 3 is a view similar to FIG. 2 showing a pair of container body blanks being gripped by the transfer mechanism at the load station.
Figure 4:
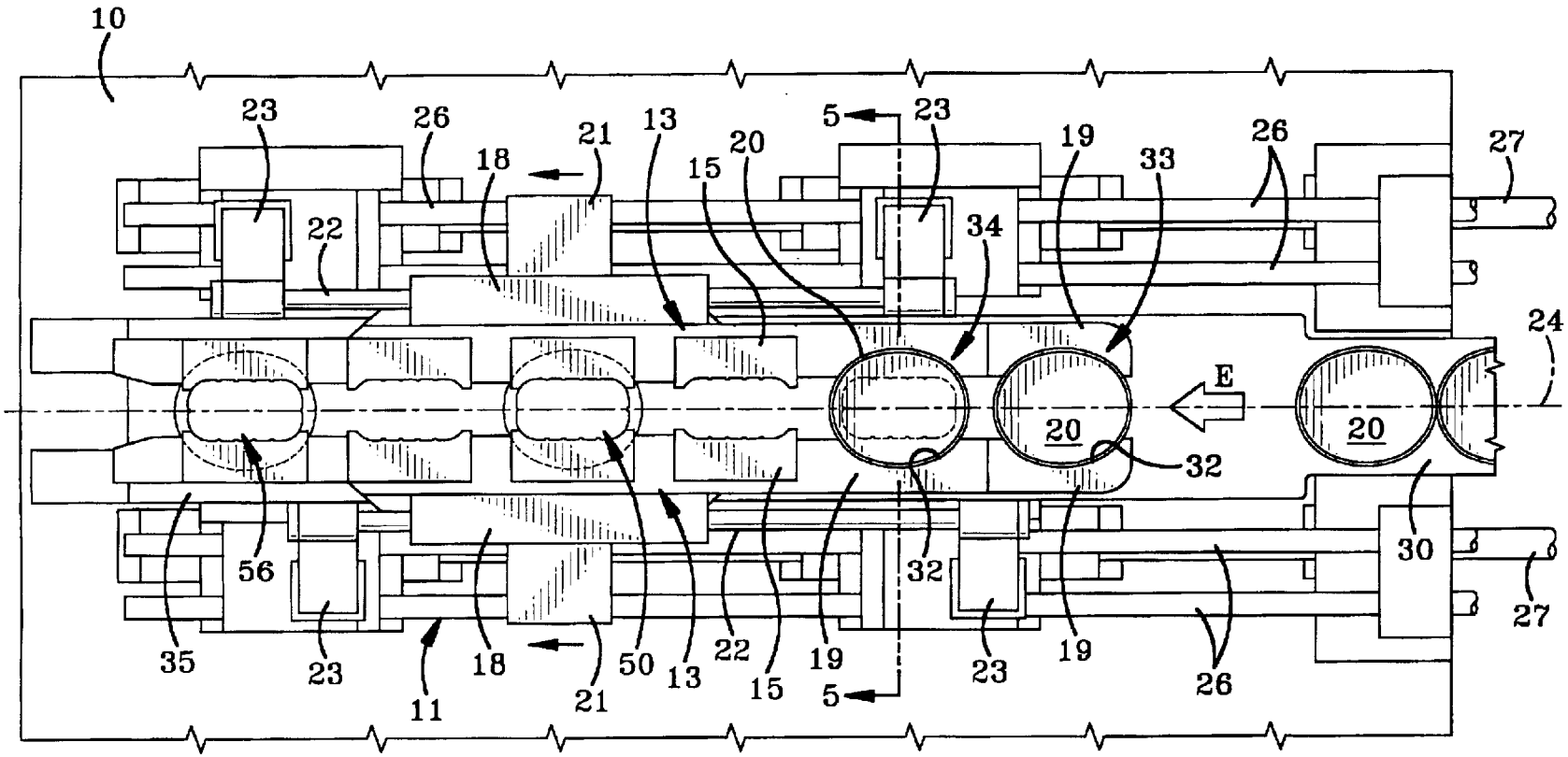
FIG. 4 is a view similar to FIG. 3 showing a container body blank at the redraw station.

Another pair of control rods 27 are operatively connected to cam boxes 23 and are moved linearly (FIG. 2, arrows B) with respect to the press base for pivotally moving mounting blocks 18 through linkage connections 16 and cam boxes 23. This linear movement of rods 27 moves gripper bars 13, and correspondingly grippers 15 and 19, perpendicularly with respect to press axis 24, between a retracted non-gripping position as shown in FIGS. 2, 6, 9, and 11, and a gripping position as shown in FIGS. 3 and 4.

This particular motion of gripper bars 13, and correspondingly of grippers 15 and 19, which are rigidly attached thereto, in the linear direction of arrows C (FIG. 2) parallel with press axis 24, and in the perpendicular direction thereto (arrows D, FIG. 3), is well known in transfer mechanisms used in container body forming presses, and thus is not described in greater detail.

Figure 5:
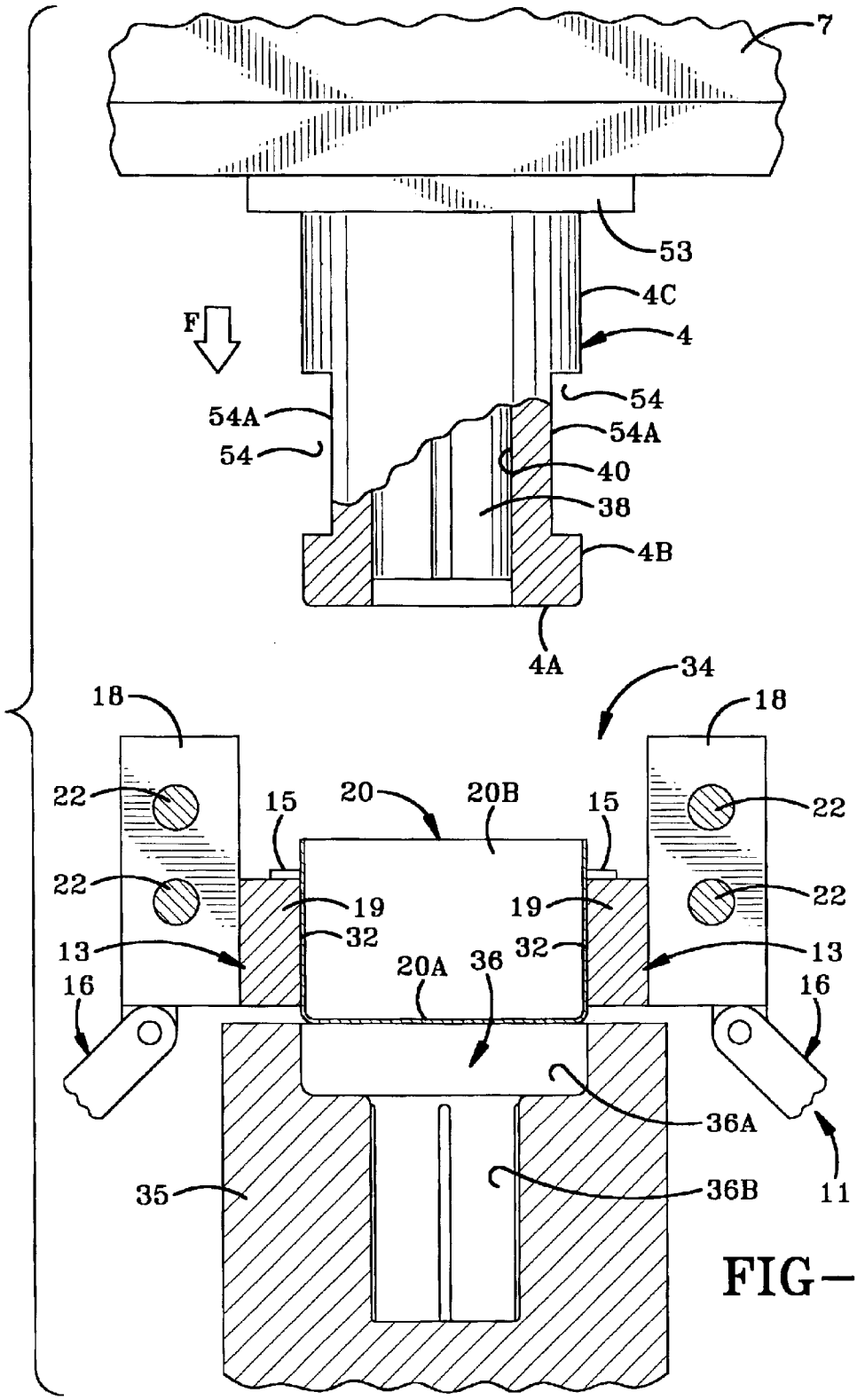
FIG. 5 is an enlarged sectional view taken on line 5—5, FIG. 4.

In forming can bodies 17, a plurality of the oval-shaped can blanks 20, which have been previously drawn into this shape from a flat disc-shaped metal blank, are moved along a feed chute 30, and into position adjacent grippers 19 at a load station indicated generally at 33. The grippers 19 will move from their retracted position as shown in FIG. 2, to a gripping position as shown in FIG. 3, by movement of control rods 27. Grippers 19 will grip a pair of can blanks 20, afterwhich they are moved linearly along press axis 24 in the direction of arrow E from the position of FIG. 3 to that of FIG. 4; that is, from load station 33 to a redraw station 34. The can blanks 20 are retained in their proper orientation within concave recesses 32 formed in grippers 19. After reaching the first work station (redraw station 34), the inner ram of the press moves punch holders 3 and pressure sleeves 4 and 5 downwardly in the direction of arrow F (FIG. 5).

When can blank 20 arrives at redraw station 34 (FIGS. 4 and 5), it will be located above a die cavity indicated generally at 36, which is formed in a die 35 secured to press base 10. Die cavity 36 will have an upper cavity portion 36A, which will have an oval-shaped configuration similar in shape and size as can blank 20, and a lower die cavity portion 36B, which for the particularly forming operation shown in the drawings, will have a generally rectangular shape corresponding to the particular shape of the desired can body 17 to be formed therein. As indicated above, one example of the type of container body 17 or can being produced by press 1, is shown in U.S. Pat. Nos. D-419,442 and 6,237,388.

Figure 6:
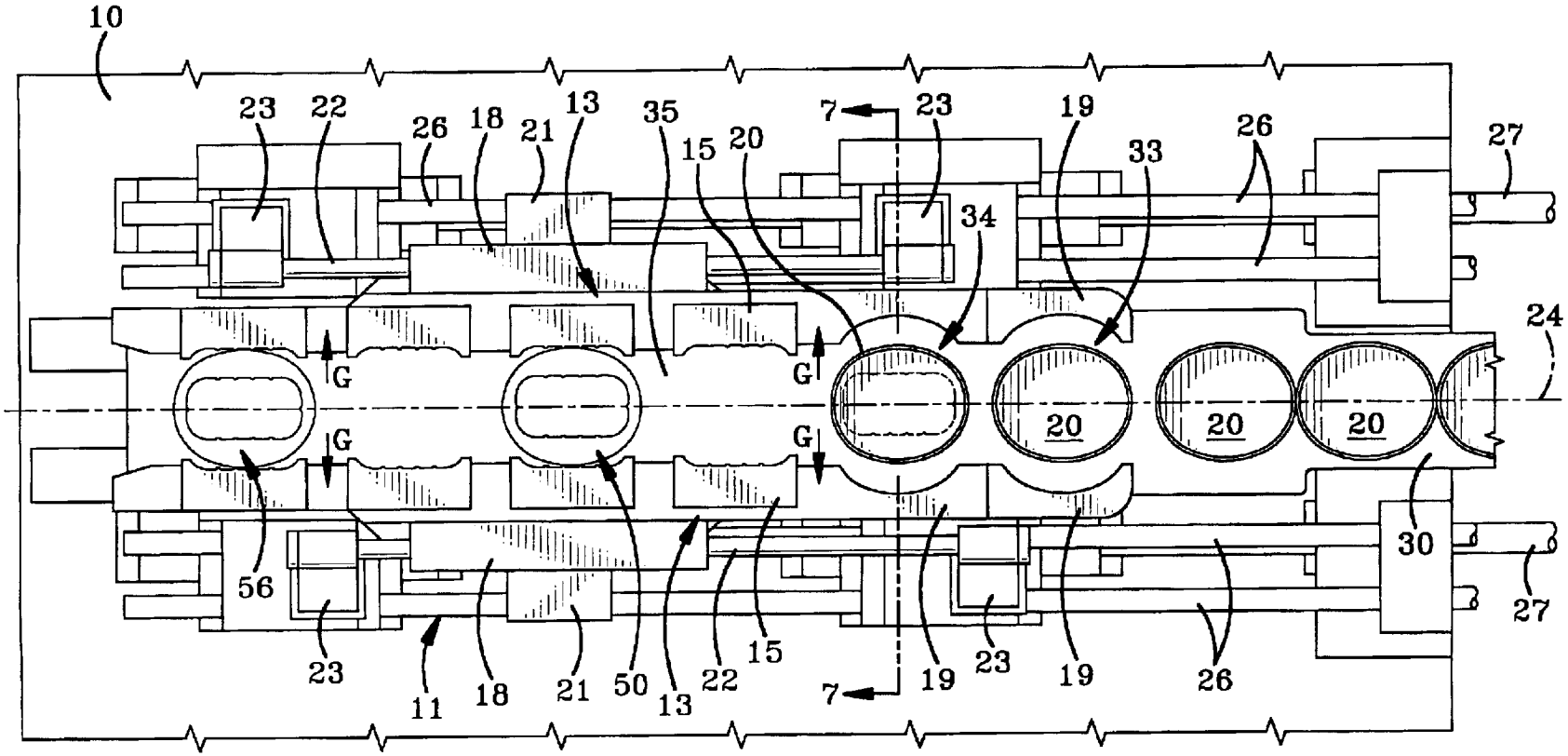
FIG. 6 is a view similar to FIG. 4 showing the transfer mechanism being retracted from the container body blank at the redraw station.
Figure 7:
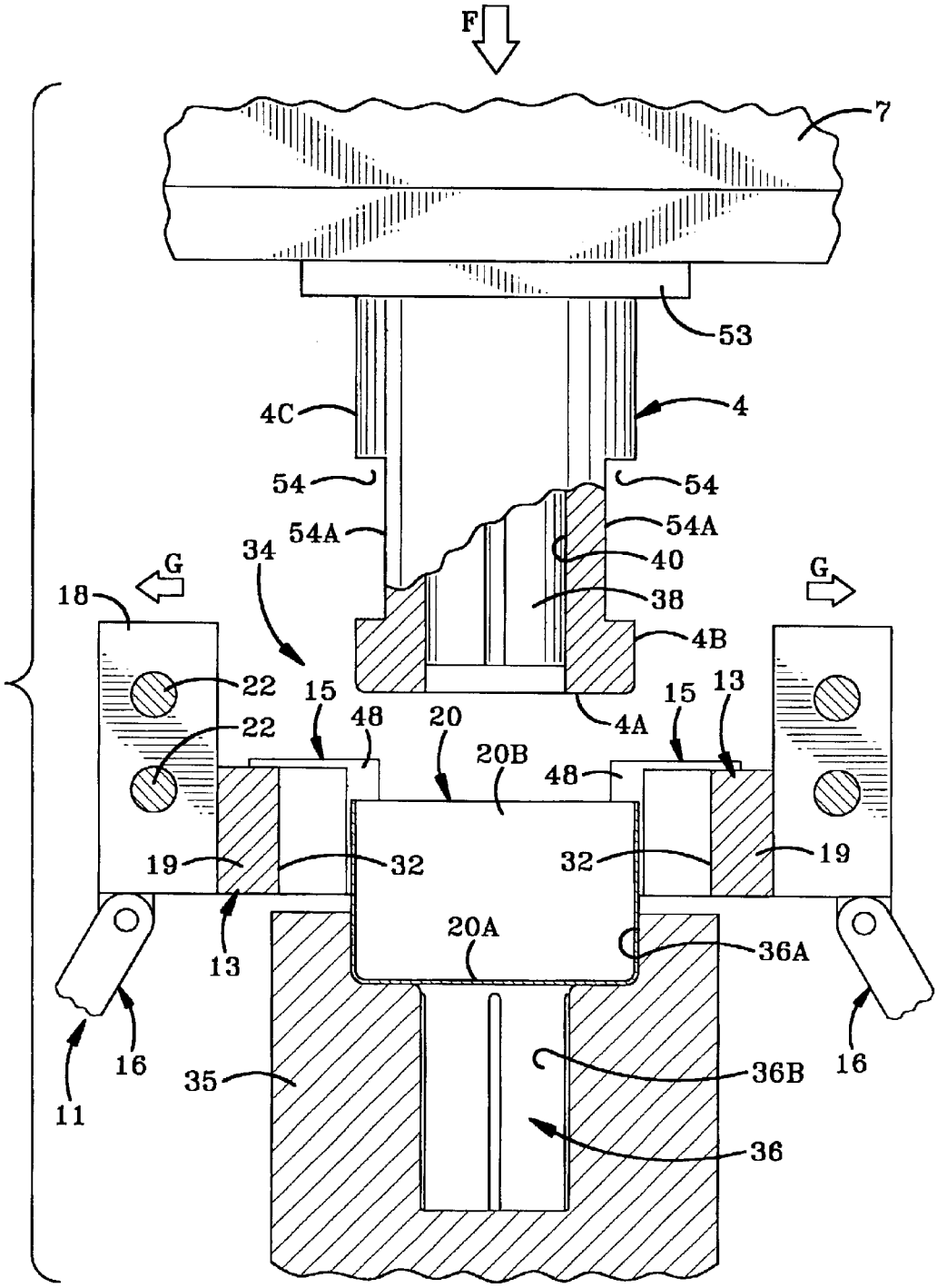
FIG. 7 is an enlarged fragmentary sectional view taken on line 7—7, FIG. 6 showing the pressure sleeve and internal die punch moving toward the container body blank at the redraw station.

Upon can body blank 20 arriving at redraw station 34, gripper bars 13 will move in the direction of arrows G toward a retracted position as shown in FIGS. 6 and 7, by movement of rods 27 and cam boxes 23. The can blank will then drop by gravity into the upper portion of die core cavity 36A. Pressure sleeve 4 will then move downwardly in the direction of arrow F (FIG. 7) by outer ram 7 until bottom wall 4A thereof engages bottom wall 20A of can blank 20. A lower side wall portion 4B of sleeve 4, which closely coincide with side wall 20B thereof, will securely hold can blank 20 in position in upper portion 36A of die cavity 36. A die punch 38, which extends through a central bore 40 of pressure sleeve 4, is moved downwardly in the direction of arrow H (FIG. 8) by inner ram 2, and redraws the generally oval-shaped can blank 20 into the desired generally rectangular-shaped can body 17 in die cavity 36B. An outer flange 41 will be formed on and extends about the open end of can body 17 at redraw station 34. Bore 40 in cross-section (FIG. 14) will have a generally elongated rectangular shape with a pair of opposed side walls 40A and a pair of opposed end walls 40B connected to the side walls by curved corners 40C.

Figure 9:
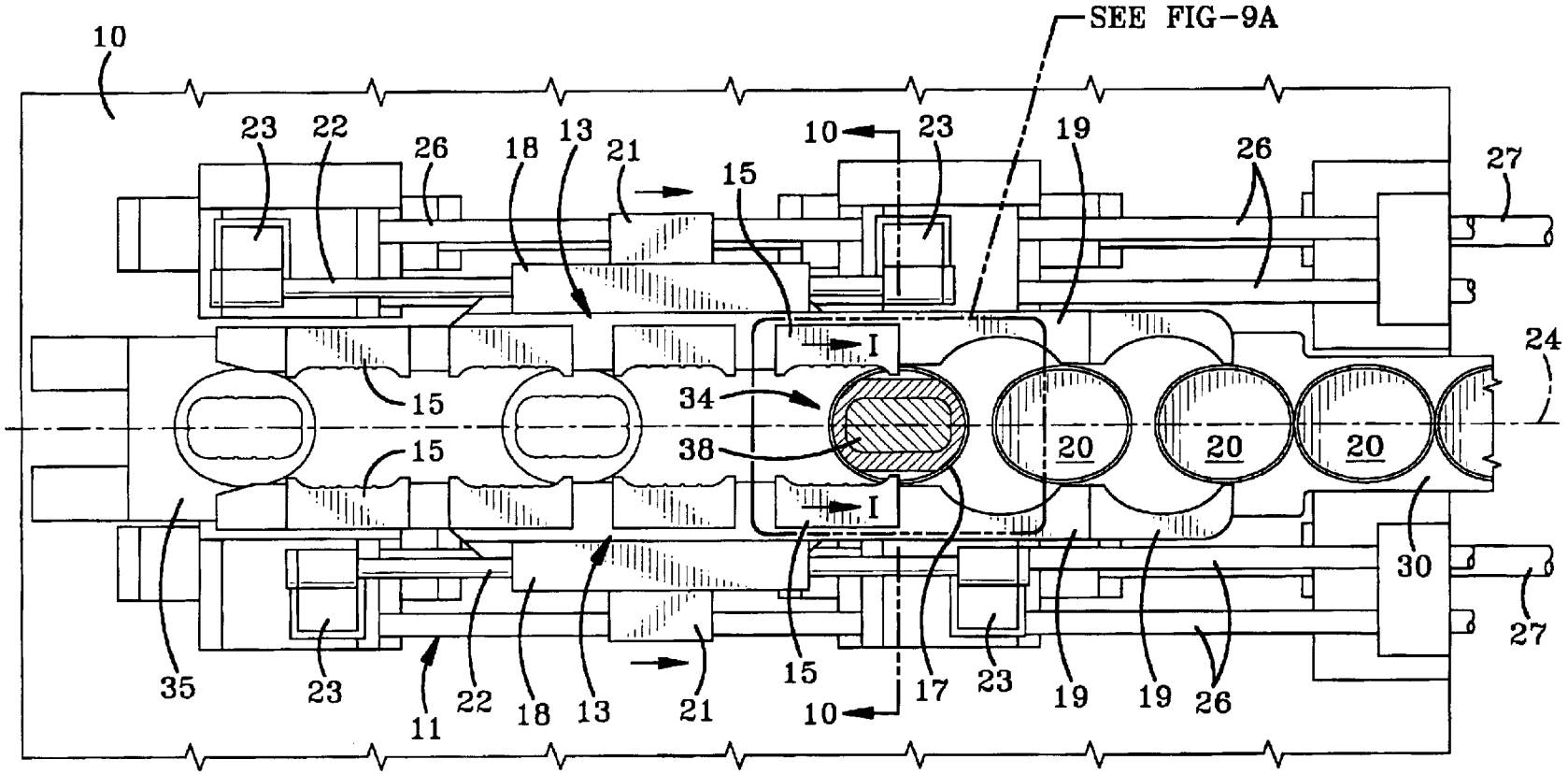
FIG. 9 is a view similar to FIG. 6 showing the transfer mechanism moving from the redraw station back toward the load station of FIG. 1.
Figure 9A:
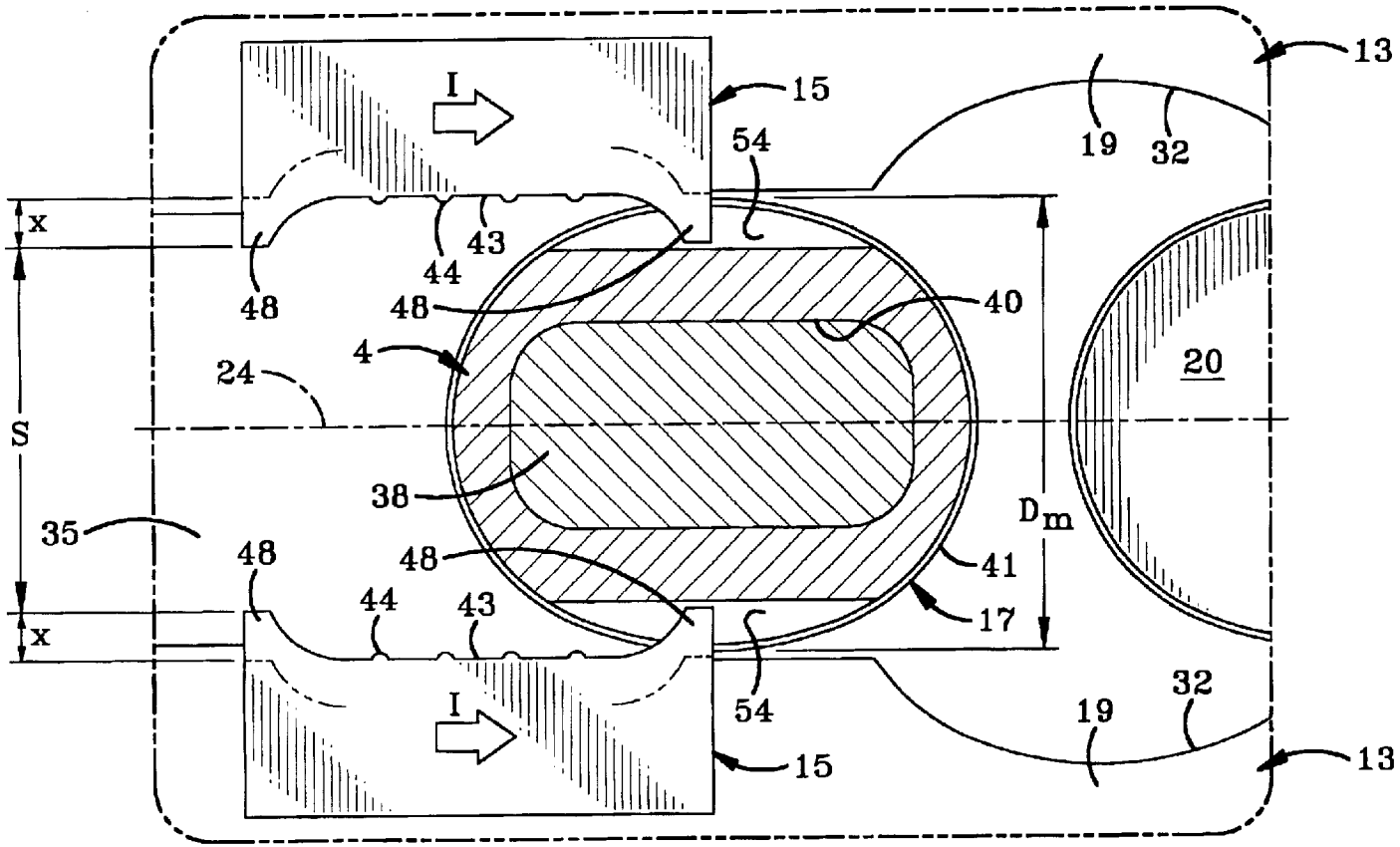
FIG. 9A is an enlarged fragmentary sectional view of the encircled portion shown in dot dash lines in FIG. 9.

As shown in FIG. 9A, grippers 15 preferably are formed with an elongated concave recess 43 and may have a plurality of small ribs or projections 44 extending outwardly therefrom for engagement with grooves (not shown) formed in the side walls 46 of formed can body 17. Grippers 15, and in particular concave recess 43, terminates in curved end portions 48, which when in the inwardly clamped position as shown in FIG. 3, will extend partially about the curved edges of can body 17 to provide a firm capture of the can body between the grippers enabling the can body 17 to be moved securely to the next adjacent work station 50. A stepped shoulder and bottom profile is applied to can body 17 in cooperation with second pressure sleeve 5 at work station 50, which again is a well known procedure in the can body making art, and is disclosed in U.S. Pat. No. 6,237,388.

Figure 8:
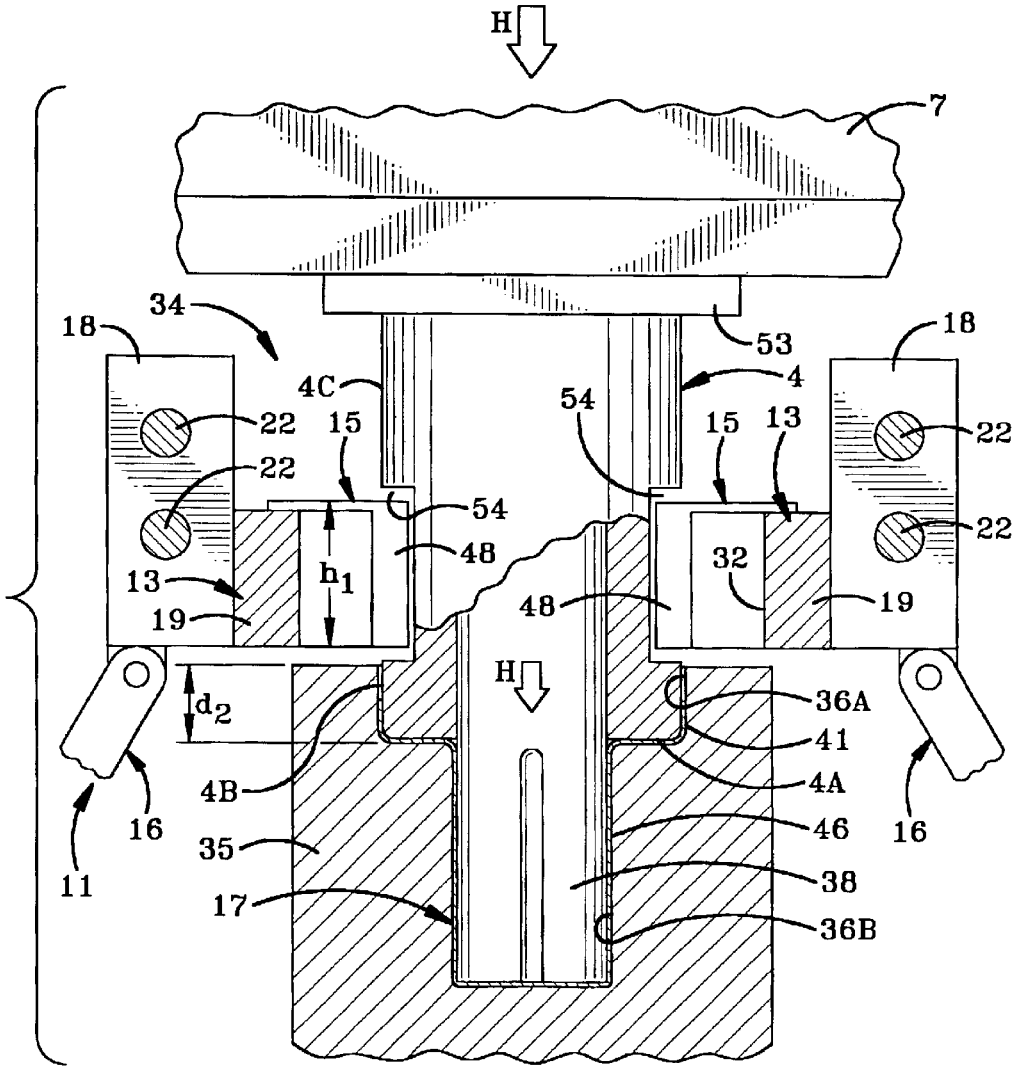
FIG. 8 is a view similar to FIG. 7 showing the container body blank being redrawn into a generally rectangularly-shaped can body.
Figure 10:
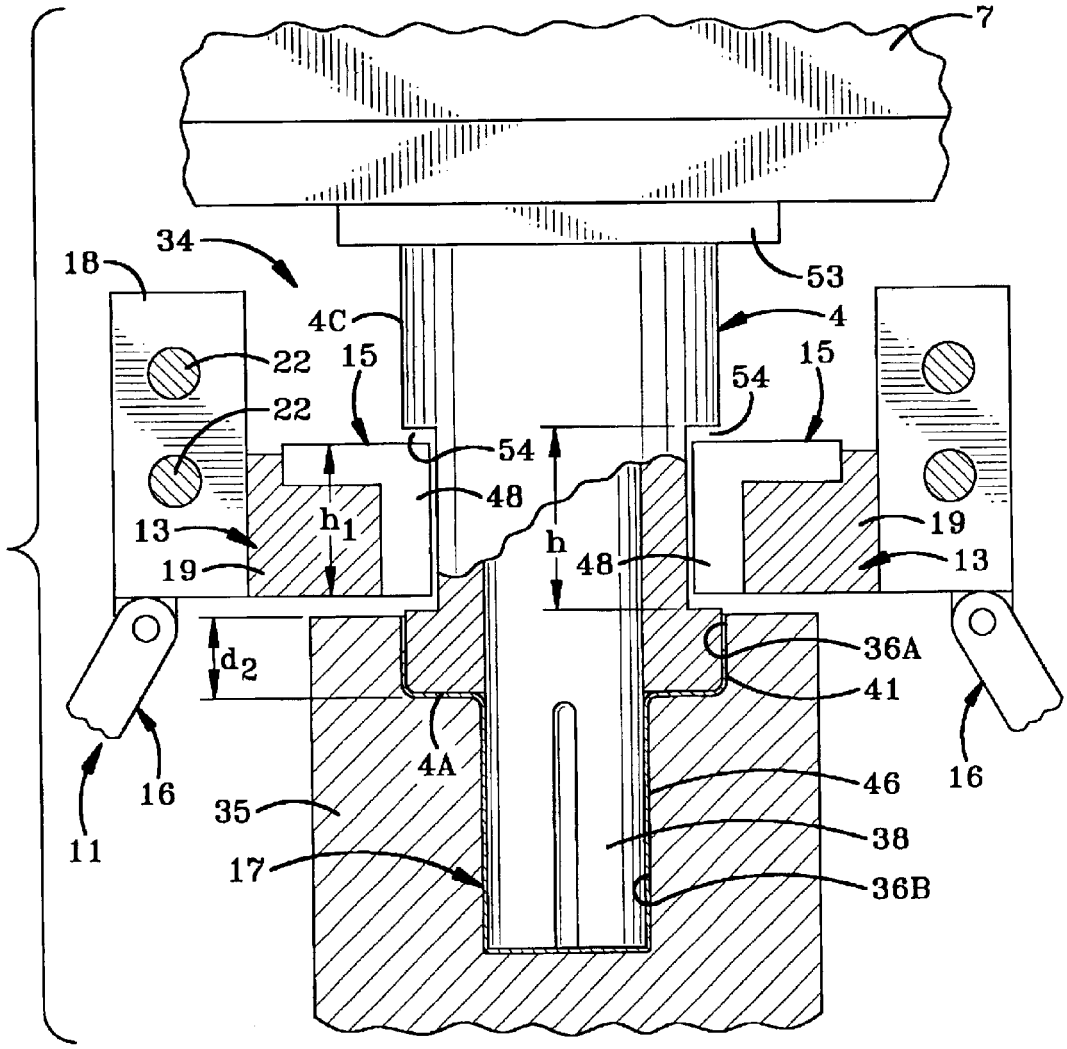
FIG. 10 is an enlarged fragmentary sectional view taken on line 10—10, FIG. 9 showing the transfer mechanism moving past the pressure sleeve at the redraw station.
Figure 11:
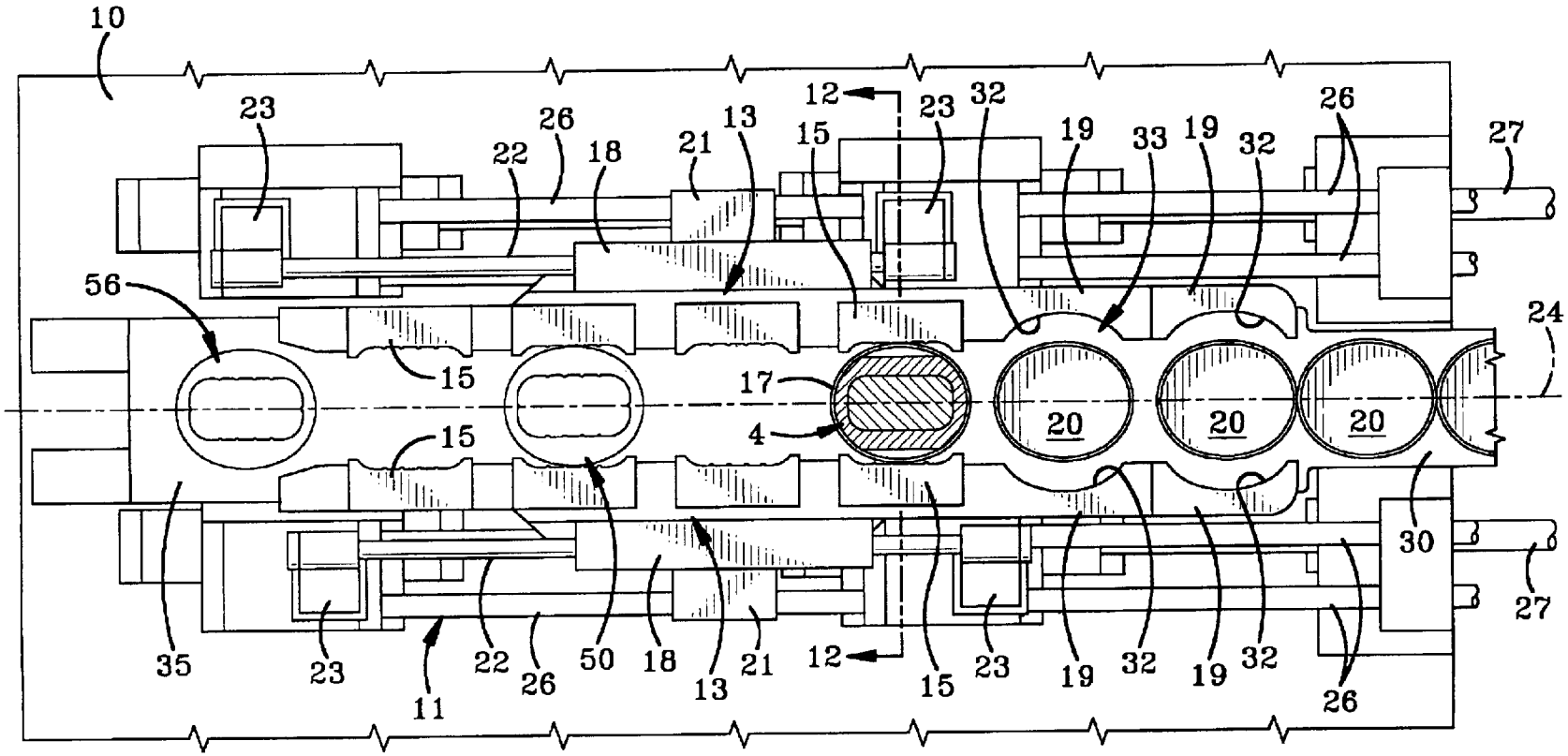
FIG. 11 is a view similar to FIG. 9 showing the transfer mechanism back at the load station.
Figure 12:
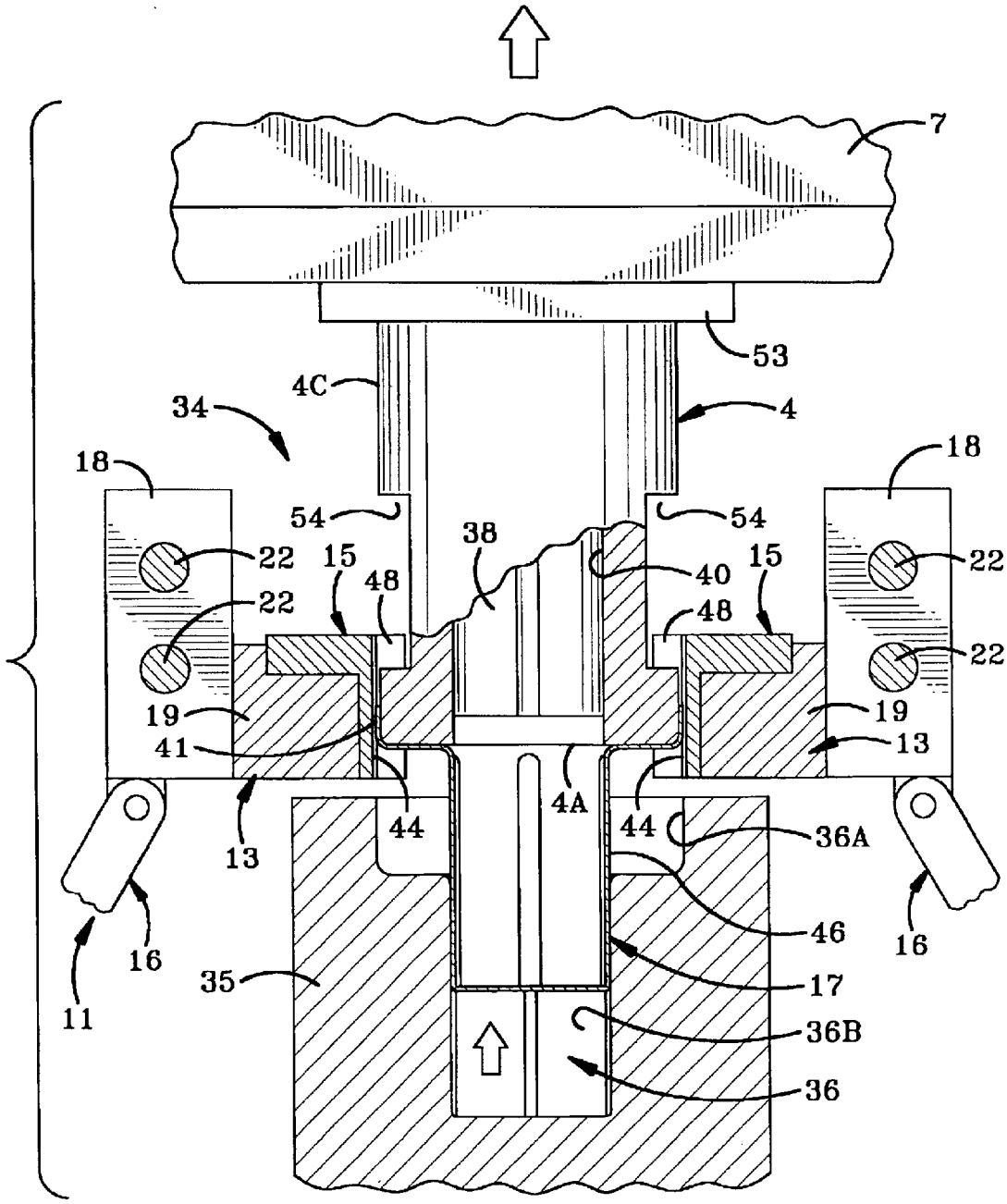
FIG. 12 is an enlarged fragmentary sectional view taken on line 12—12, FIG. 11.
Figure 13:
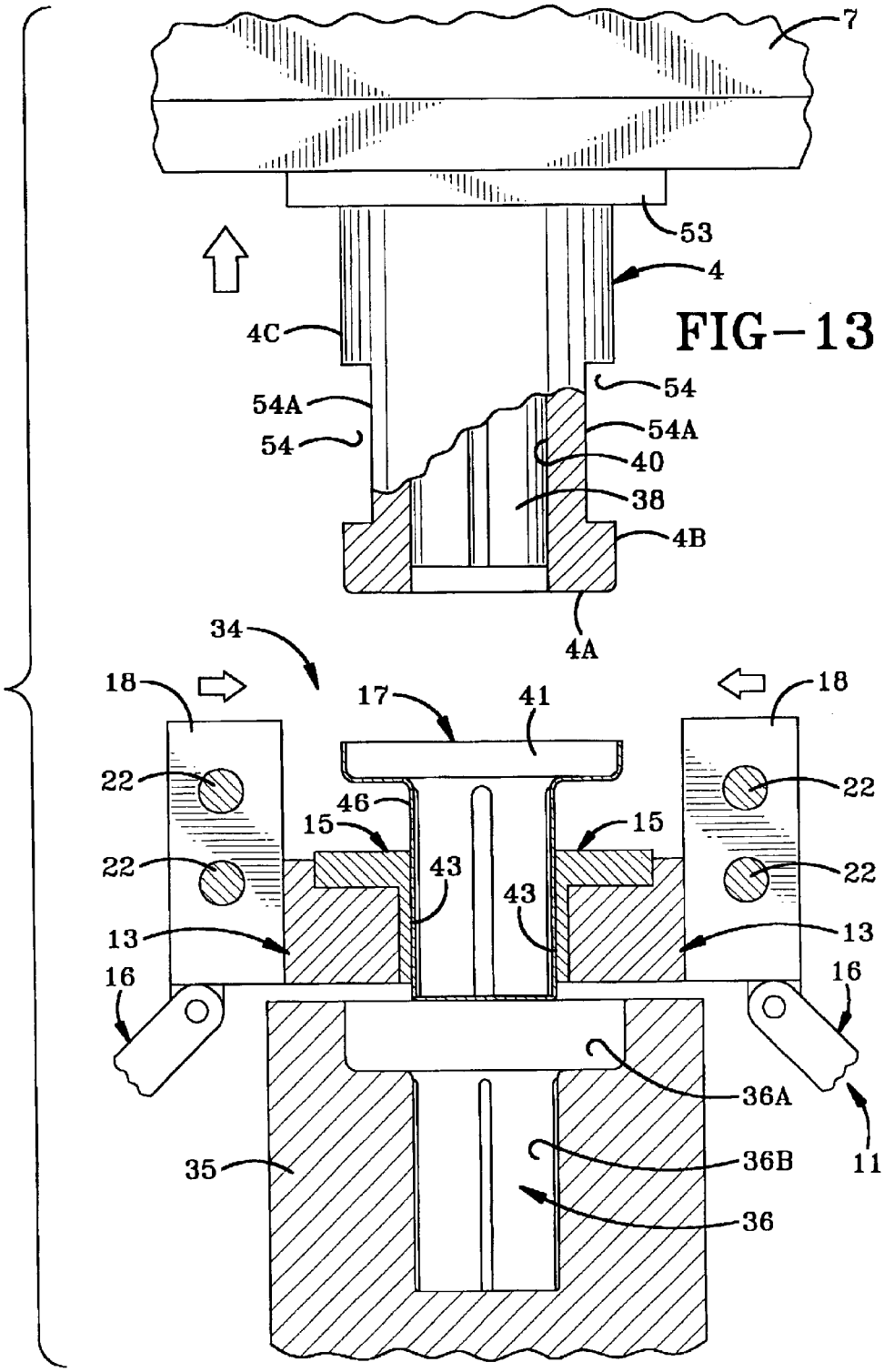
FIG. 13 is a view similar to FIG. 12 showing the pressure sleeve and redraw die in a raised position and the formed rectangular container body being released from the redraw die.

It is curved ends 48 of grippers 15 which have to be retracted a sufficient distance perpendicularly from axis 24 so that the grippers can move linearly past pressure sleeve 4, when sleeve 4 is in a downward holding position as shown in FIGS. 8, 9A, and 10 to enable the transfer mechanism to return toward the pickup station position of FIG. 2. Gripper bars 13 and grippers 15 and 19 move from their forwardmost position of FIG. 4 to the rearward most position of FIGS. 2 and 11 for pickup of another can body blank 20 and to start another transfer cycle from the load position of FIGS. 2 and 11 back to the position of FIG. 4. It is readily understood that the previously formed can body 17 will have moved from redraw station 34 to the shoulder and bottom profile station 50, and during the next several cycles will move to the third work station (referred to as the trim station), wherein outer flange 41 is trimmed by a trim mechanism in cooperation with pressure sleeve 6, upon the downward movement of outer ram 7. Again, these subsequent procedures and movement of the formed and partially formed can bodies linearly along the press are well known in the art, and are shown more fully in U.S. Pat. No. 6,237,388. The above-described procedures and apparatus is present in many can body forming presses using such a transfer mechanism and associated forming dies, and thus all of the details, manner of movement of the inner and outer rams, transfer mechanisms, and relationship between the various press components is not described in further detail.

Figure 15:
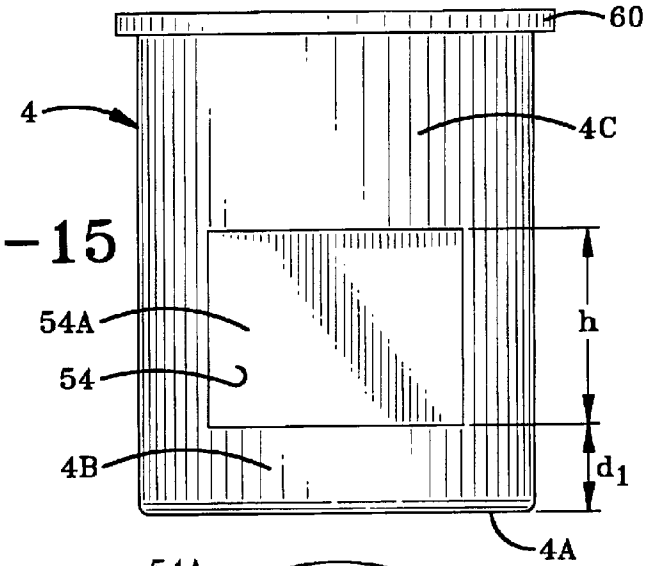
FIG. 15 is a side elevational view of the pressure sleeve of FIG. 14.
Figure 16:
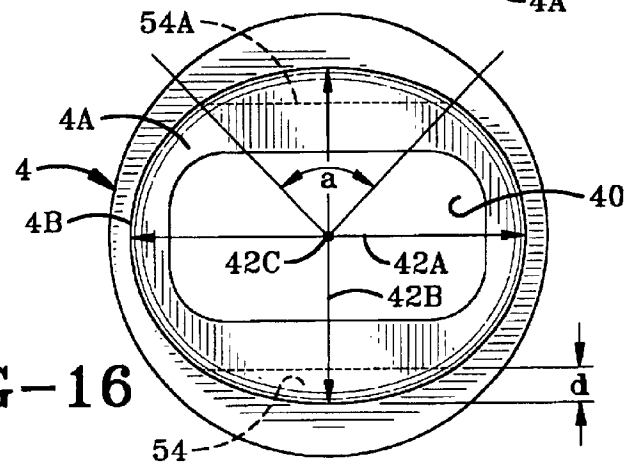
FIG. 16 is a bottom plan view of the pressure sleeve.
Figure 14:
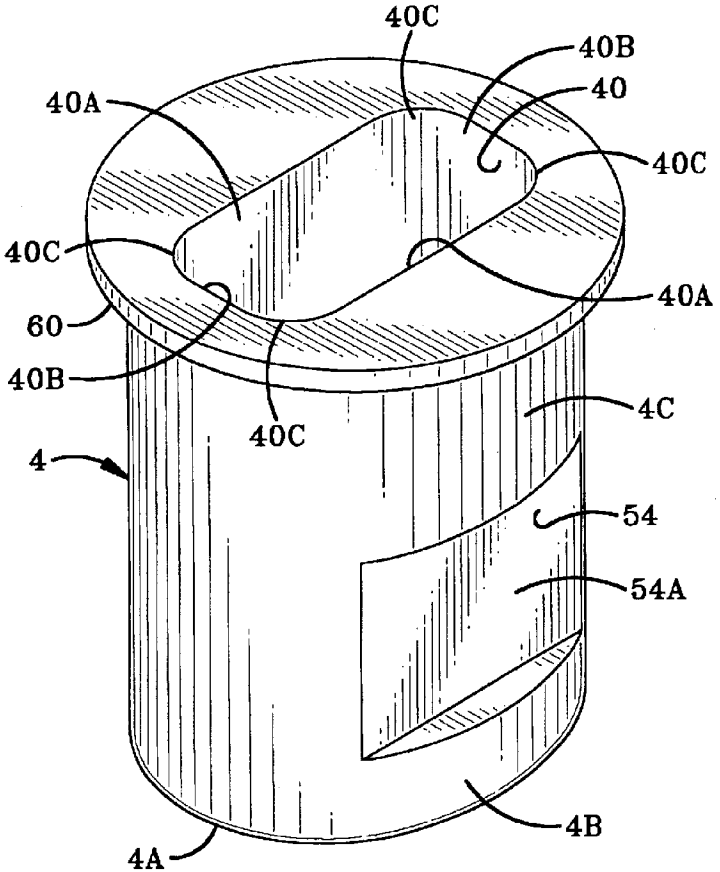
FIG. 14 is a top perspective view of the improved pressure sleeve of the present invention.

In accordance with the invention, pressure sleeve 4 which is located at redraw station 34, is formed with a pair of diametrically opposed cutouts or notches 54 in side wall 4C thereof(FIGS. 14-16). Cutouts 54 are formed in the more elongated portion of oval-shaped side wall 4C of pressure sleeve 4. The depth "d" of notches 54 as shown in FIG. 16, is determined by the size and material thickness of pressure sleeve 4, and in particular side wall 4C thereof, and extends throughout an arc "a" of approximately 90°. Notches 54 have a height "h" (FIG. 15), which is slightly greater than the height "$h_1$" of grippers 15, and in particular the height of the gripper curved end portions 48 as shown in FIG. 8. Likewise, the height of side wall portion 4B, which extends between bottom wall 4A and the bottom of notch 54, is at a distance "$d_1$", which will be approximately equal to and preferably slightly greater than the depth $d_2$ of upper cavity portion 36A of die core cavity 36. Also, side wall portion 4B will usually have an axial height less than that of the side wall portion between the top of the sleeve and the top of notches 54. This relationship insures that the metal of the can body blank 20 is held in a secured clamped position as shown in FIG. 8, while can body blank 20 is being redrawn into can body 17. It is during this redraw step, shown in FIGS. 8, 9, and 9A, that grippers 15 are moving linearly along press base 10 back toward the load station, as shown by arrows I (FIG. 9), in which position the grippers are in their fully retracted position, whereby curved ends 48 will pass through notches 54 of pressure sleeve 4 as shown in FIG. 9A. Were it not for the use of notches 54, grippers 15 would have to be retracted an additional distance "x", as shown in FIG. 9A, so that curved ends 48 thereof will move beyond the outer circumference, or side wall 4C, of pressure sleeve 4. Although this distance "x" is relatively small, less than an inch, tests have shown that by the use of notches 54 which reduces the travel distance by distance "x", it enables the cycle speed of the press to be increased by at least 20%.

As shown in FIG. 9A, the edges of curved ends 48 of grippers 15 need only have a maximum separation distance S, which distance is less than the minor diameter $D_m$ of pressure sleeve 4.

Pressure sleeve 4, as shown in FIGS. 14–16, is of a usual construction, consisting of a generally oval-shaped side wall 4C having a generally elongated rectangular-shaped bore 40 extending therethrough providing a passage for the movement of die punch 38. Oval-shaped side wall 4C (FIG. 16) is defined by major and minor axii 42A and 42B, respectively, which intersects at a central axis 42C. A top annular flange 60 enables pressure sleeve 4 to be clamped in a secure position on outer ram 7 by a clamp ring 53 (FIG. 1). Again, the construction and features of press 1 are known in the can body making art. However, the unique formation of diametrically opposed notches 54 in the side wall of pressure sleeve 4, which is located at the redraw station, enables the desired advantages to be achieved, that is, it reduces the distance that the gripper bars must move between gripping and retracted positions and visa versa, in order to provide clearance between the grippers and pressure sleeve when moving from the redraw station back toward the load station, when the pressure sleeve is lowered in a pressure engaged position with the can blank as shown in FIGS. 8–10. Notches 54 are formed in those portions of side wall 4C generally defined by minor axis 42B, and have generally flat inner walls 54A, which are parallel to each other as shown in FIG. 16.

Thus, the particular operation of press 1 and the formation of can body 17, including applying the stepped shoulder and bottom profile thereto at station 50, and trimming outer flange 41 at the trim station 56, need not be modified in any manner. The only difference or change to the press and its manner of operation is lessening the movement of the gripper bars, and in particular, the movement of the first gripper 15 which moves past pressure sleeve 4, when moving between retracted and gripping positions, that is perpendicularly to longitudinal axis 24 of the press, in order to achieve the increased production speed of the press due to the formation of notches 54 in the side wall of pressure sleeve 4 located at redraw station 34.

Although the above discussion is with respect to the use of a oval-shaped pressure sleeve 4 and the formation of a generally rectangular-shaped can body 17 from an oval-shaped blank 20, which can blank is complementary to the can shape and size of pressure sleeve 4, other can body blanks, and resulting can body shapes can be used with a pressure sleeve having the unique clearance notches 54 formed therein.

Accordingly, the improved method and apparatus of the present invention provides for increased production speed in a usual transfer press for the forming of can bodies without materially changing the mode of operation of the press or movement of the workpieces therethrough by the unique formation of a pair of notches or cutouts in the side wall of the pressure sleeve, which sleeve holds a can body blank in the die cavity at the redraw station, where the oval-shaped can body blank is drawn into a generally rectangular-shaped can body, which is subsequently moved through a pair of work stations which form a stepped shoulder and bottom profile in the can body at a next station and then trims an outer rim or flange of the can body at a trim station before the can body is ejected from the press.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. Apparatus for forming a container body from a workpiece at a forming station in a press having a base, at least one ram moveable towards and away from the base, and a transfer mechanism for moving the workpiece along the base, said apparatus comprising:

a die mounted on the base;

a pressure sleeve carried by the ram in opposed relationship with the die, said sleeve having a side wall and a bottom wall for maintaining the workpiece in the die as a forming punch moves through the pressure sleeve for drawing the workpiece into a container body in the die, said sleeve further having a pair of opposed notches formed in the side wall and spaced from the bottom wall to provide clearance from the transfer mechanism as the transfer mechanism moves linearly along the base.

2. The apparatus defined in claim 1 wherein the transfer mechanism includes a pair of gripper bars moveably positioned on opposite sides of the workpiece, and a plurality of grippers mounted on the gripper bars for gripping the workpiece and container body and moving said workpiece and container body along the press.

3. The apparatus defined in claim 2 wherein at least a pair of the grippers, which are opposed to each other, have a concave gripping surface terminating in a pair of outwardly extending curved ends.

4. The apparatus defined in claim 3 wherein curved ends of the opposed pair of grippers have a height "$h_1$"; in which the notches have a height "h"; and in which "h" is greater than "$h_1$".

5. The apparatus defined in claim 3 wherein the pressure sleeve has a generally oval cross-sectional configuration with major and minor diameters; and in which the curved ends of the opposed pair of grippers have a maximum separation distance of S, which distance is less than the minor diameter of the pressure sleeve.

6. The apparatus defined in claim 1 wherein the pressure sleeve is formed with a central bore having a generally rectangular shape with a pair of elongated side walls and a pair of ends walls connected to said side walls by curved corners.

7. The apparatus defined in claim 1 wherein the side wall of the pressure sleeve will have a generally oval shape; and in which the notches extend throughout an arcuate length of between approximately 90° of said side wall.

8. A method for forming a container body from a container blank in a reciprocating press having a linear axis of movement along a base of the press, comprising the steps of:

moving the blank along the press axis from a blank pickup station to a first work station by a pair of opposed grippers;

moving a pressure sleeve into holding engagement with the blank and drawing the blank into the container body in a die cavity at the first work station;

withdrawing the grippers from the blank a predetermined withdrawal distance during the step of drawing the blank into the container body at the first work station;

moving the grippers back toward the pickup station along the linear axis of the base; and passing at least a portion of the grippers through notches formed in a side wall of the pressure sleeve to reduce the withdrawal distance from the pressure sleeve when the grippers are moving back toward the pickup station.

9. The method defined in claim 8 including the step of providing the grippers with a concave recess which terminates in a pair of curved ends.

10. The method defined in claim 9 including the steps of providing the curved ends of the grippers with a height "$h_1$"; and providing the notches with a height "h" greater than the height "$h_1$" of the grippers.

11. The method defined in claim 8 including the steps of providing the pressure sleeve with a hollow bore; and moving a forming die through said bore to draw the blank into the container body at the first work station.

12. The method defined in claim 8 including the steps of providing the container blank with an oval shape complementary to the pressure sleeve; and forming the container body with an elongated generally rectangular shape complementary to the die cavity.

13. A pressure sleeve for forming a container body in a press, said sleeve including a side wall, top and bottom walls, a bore extending through said sleeve for receiving a die punch, and a pair of notches formed opposite of each other in the side wall and spaced above the bottom wall.

14. The pressure sleeve defined in claim 13 wherein the sleeve side wall has a substantial oval cross-sectional configuration having major and minor axii; and in which the notches are formed in the portions of the side wall defined generally by the minor axis.

15. The pressure sleeve defined in claim 14 wherein the bore extends between the top and bottom surfaces and along a central axis of the pressure sleeve.

16. The pressure sleeve defined in claim 15 wherein the bore in cross-section has a generally elongated rectangular configuration defined by a pair of opposed side surfaces and a pair of end surfaces connected to the side surfaces by curved corners.

17. The pressure sleeve defined in claim 13 wherein an annular flange extends outwardly from the side wall adjacent the top wall.

18. The pressure sleeve defined in claim 13 wherein the notches each have a generally flat inner wall parallel to each other.

19. The pressure sleeve defined in claim 13 wherein the notches are spaced from the bottom wall by a distance less than from the top wall.

20. The pressure sleeve defined in claim 13 wherein the notches are similar to each other in size and shape.

* * * * *